United States Patent [19]

Subera et al.

[11] 4,207,747

[45] * Jun. 17, 1980

[54] AIR DEFROST SYSTEM USING SECONDARY AIR BAND COMPONENTS

[75] Inventors: Elmer J. Subera, Cassopolis; Melvin W. Steelman, Niles, both of Mich.

[73] Assignee: Tyler Refrigeration Corporation, Niles, Mich.

[ * ] Notice: The portion of the term of this patent subsequent to Mar. 20, 1998, has been disclaimed.

[21] Appl. No.: 928,313

[22] Filed: Jul. 26, 1978

Related U.S. Application Data

[62] Division of Ser. No. 790,654, Apr. 25, 1977, Pat. No. 4,144,720.

[51] Int. Cl.[2] ..... F25D 21/12

[52] U.S. Cl. ..... 62/82

[58] Field of Search ..... 62/255, 80, 256, 82, 62/282; 417/315; 415/149

[56] References Cited

U.S. PATENT DOCUMENTS

| | | | |
|---|---|---|---|
| 3,094,851 | 6/1953 | Beckwith | 62/256 |
| 3,182,466 | 5/1956 | Beckwith | 52/255 X |
| 3,850,003 | 11/1974 | Beckwith et al. | 62/256 X |
| 3,937,033 | 2/1976 | Beckwith et al. | 62/256 X |
| 4,026,121 | 5/1977 | Aokage et al. | 62/256 X |

*Primary Examiner*—Albert J. Makay

*Assistant Examiner*—William E. Tapolcai, Jr.

*Attorney, Agent, or Firm*—LeBlanc, Nolan, Shur & Nies

[57] ABSTRACT

An improved upright open front refrigerated display cabinet having primary and secondary air flow conduits, in which air flow directing means are provided for selectively drawing ambient air into the secondary air band conduit during a defrost cycle and for substantially preventing ambient air from entering the secondary conduit during a refrigeration cycle and for directing the flow of air through the secondary conduit in a first direction during the refrigeration cycle and in a second direction, substantially opposite the first direction, during the defrost cycle. Fans are provided in each of the primary and secondary conduits; the direction of air flow in the primary conduit remains constant at all times, during both refrigeration and defrost cycles. The secondary band fans propel air in a first direction (codirectional with air flow in the primary conduit) during the refrigeration cycle and in a second direction, substantially opposite the first direction during the defrost cycle whereby the ambient air is mixed with air propelled by primary fans in the primary conduit. Finally, means are provided for diverting air from the secondary conduit to the primary conduit during the defrost cycle and for substantially preventing the diversion of air from the secondary conduit to the primary conduit during the refrigeration cycle.

4 Claims, 13 Drawing Figures

FIG. 6
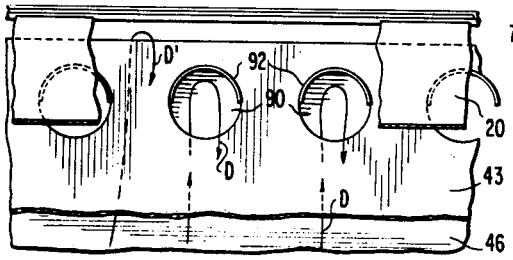
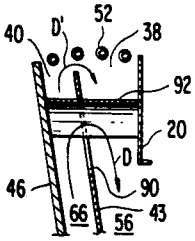
FIG. 5
FIG. 7
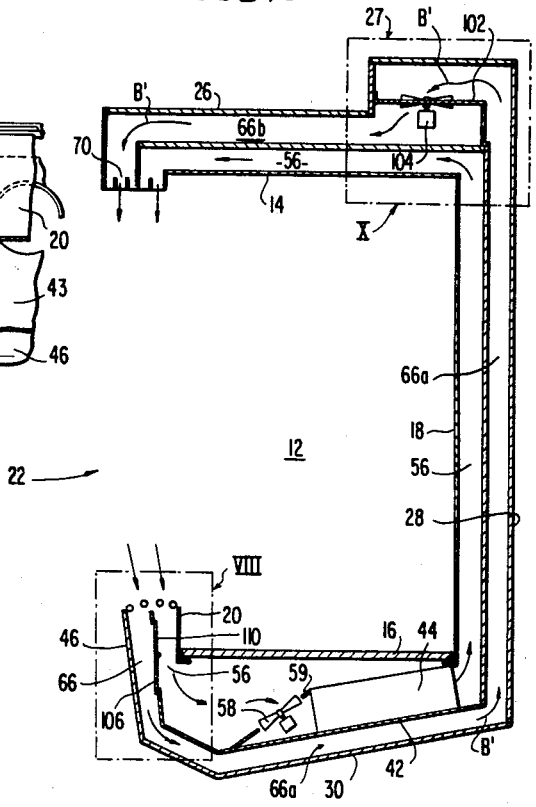
FIG. 8
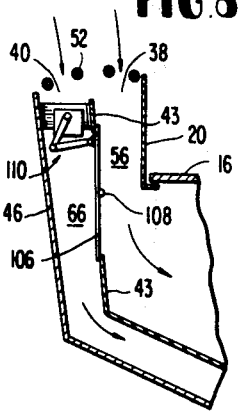
FIG. 9
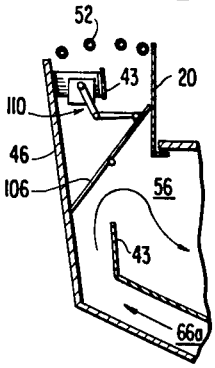
FIG. 10
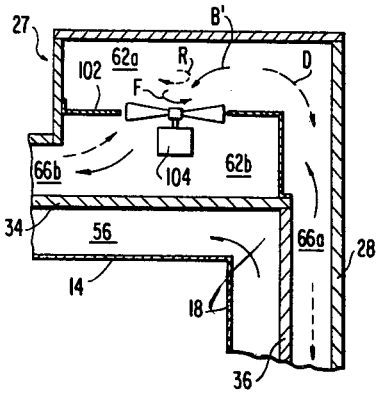

FIG. 11
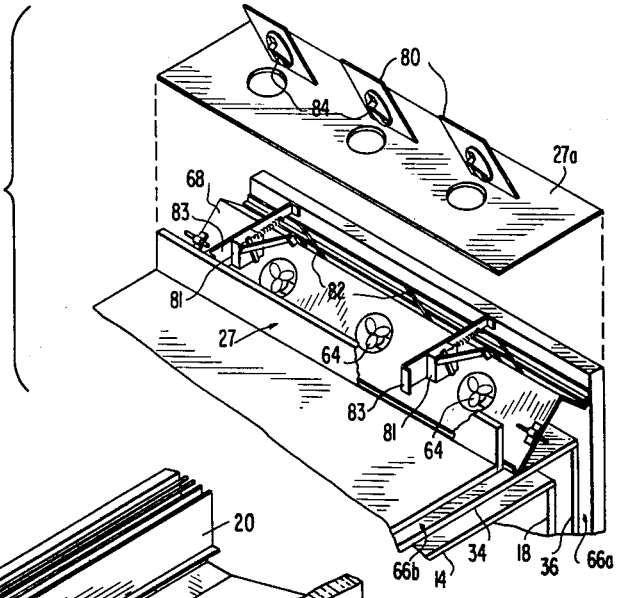
FIG. 12
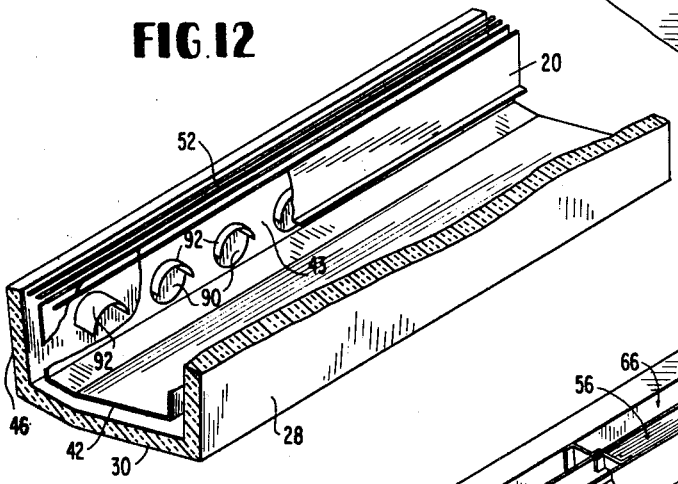
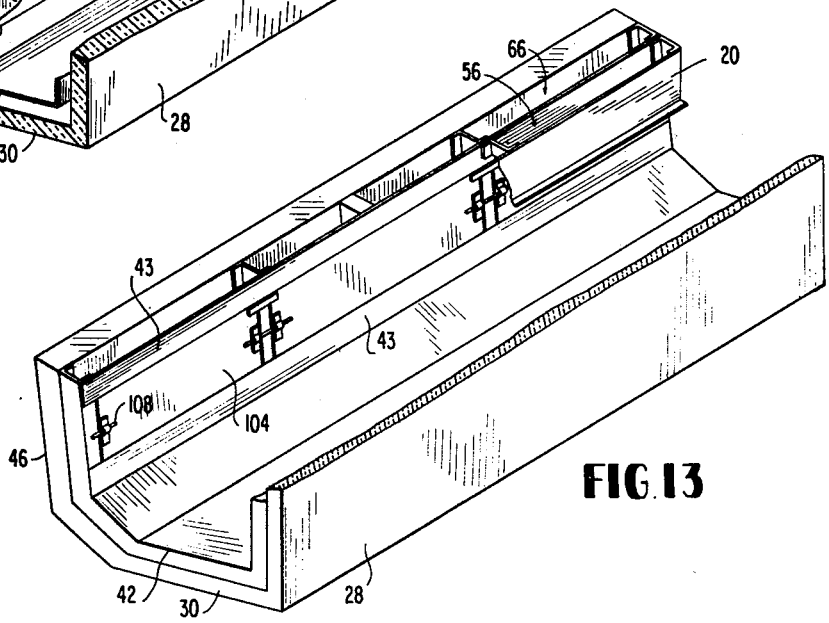
FIG. 13

AIR DEFROST SYSTEM USING SECONDARY AIR BAND COMPONENTS

This is a division of application Ser. No. 790,654, filed Apr. 25, 1977, now U.S. Pat. No. 4,144,720, issued Mar. 20, 1979.

BACKGROUND OF THE INVENTION

This invention relates to air curtain-type refrigerated display cabinets, and more particularly to a novel air defrost refrigerated display cabinet.

Multiple air curtain refrigerated display cases or cabinets have, within the past 15 to 20 years, gained wide acceptance in the food market industry. Such cabinets provide advantages in the storage and display of refrigerated or frozen foods and the like. The cabinets generally employ two or three air curtains traversing the open front of the display case; the innermost air curtain and the adjacent one are normally recirculated around the cabinet through conduits provided therein. The innermost air curtain is normally the coldest, the second one being somewhat warmer, and the third outermost one, if such is provided, being basically an ambient temperature curtain to reinforce the jet inertia of the two innermost curtains. Refrigeration means, normally in the form of one or more evaporator coil units, is located in the innermost passage for cooling the air flowing past. Periodically during operation, this innermost passage and its refrigeration means must be defrosted to remove accumulated frost on the coil collected from the cooled air and tending to impede the operation of the equipment.

Three principal types of defrosting means may be employed on commercial units. The most common type utilizes electric heaters adjacent the coils of the refrigeration means whereby high voltage electrical heaters warm the recirculating air curtain when the refrigeration operation is temporarily halted. The warmer air passing over the refrigeration coils melts snow or frost accumulated on the coils. A second type of defrosting means, far less common because of its complexity, employs heated gas which is circulated through the refrigeration coils during the defrost cycle. Hot gas defrost requires complicated valving structures to selectively channel refrigerant through the coils during the cooling cycle and hot gas through the same coils during the defrost cycle.

A third type of defrosting means, with which this invention is concerned, employs ambient air that is substantially warmer than the refrigerated air circulating through the system, to warm the coils during the defrost cycle and thus melt accumulations of snow or frost. Air defrost systems per se are not new, as evidenced by Beckwith et al. U.S. Pat. Nos. 3,403,525 issued Oct. 1, 1968, 3,850,003, issued Apr. 5, 1974, and 3,937,033 issued Feb. 10, 1976. In known systems, as exemplified by the Beckwith patents, specific fans are turned on during a defrost cycle to pull air out of the primary refrigerated air band path, exhausting this air to the atmosphere while at the same time drawing ambient air into the refrigerated band conduit. During the defrost cycle, in the known systems, the air curtain across the open front of the display case dissipates completely, thereby permitting moisture laden ambient air to infiltrate the display section during the defrost cycle. This has a tendency to cause an increase in frost build-up to occur in the display area during the refrigeration cycle.

Another Beckwith patent, U.S. Pat. No. 3,082,612, issued Mar. 26, 1963, discloses an air curtain refrigerated cabinet and defrosting means for defrosting the refrigeration coils without the need for completely shutting down the refrigeration cabinet. The cabinet utilizes the existing main air passage circulation fan for drawing in ambient air from a passage through ports located in the lower front portion of the apparatus. The ports are closed during normal operation by shutter plates. The ambient air drawn in through these passages is discharged from the main refrigeration band at a point beyond the refrigeration coils through a further passage via ports located in the rear of the apparatus. The Beckwith et al. '003 patent indicates that the concepts described in U.S. Pat. Nos. 3,082,612 and 3,403,525 did not prove practical and therefore were not commercially feasible.

The present invention comprises an arrangement whereby pivoting a fan panel opens doors to the atmosphere to place the door and the fan panel in such a position that room air may be drawn directly, by already existing fans, into the second air band of the refrigerator. This reverses the normal air flow in the second air band, thereby taking the ambient air directly into a discharge relationship at the lower front opening of the refrigerator. One purpose of this is to draw room air, with its greater heat content, into the refrigerator to be discharged in such a position that it may be drawn directly into the lower opening which supplies the air from the main refrigeration passages and components.

In an alternative arrangement, reversible fans are provided in place of the pivotable fan panel to achieve a similar result.

In addition, there is a normal arrangement between the main refrigeration passages and the second band passages whereby, during defrost, air is taken from the second band and directed by an appropriate scoop into the main refrigeration air passages. It is the purpose of this to provide, by stationary parts, a means to cause the ambient air in the second band, during defrost, to be turned into the refrigeration air passages. There is a normal tendancy of the air from the second band to turn from its discharge to be drawn into the refrigeration band with the purpose of defrosting it, essentially to accomplish the total utilization of the available ambient air for the purpose of defrosting.

In an alternative arrangement, a movable member is provided to shunt air from the second band passage into the main air passage during a defrost cycle.

It is an object of the present invention to overcome disadvantages associated with known air defrost systems.

More particularly, it is an object of this invention to circulate ambient air through the primary and secondary air band conduits during a defrost cycle.

It is a further object of the invention to maintain an air curtain across the open front of the display case during the defrost cycle to prevent infiltration of ambient air into the display area.

It is a further object of the invention to provide a means whereby ambient air is drawn directly into the secondary air band conduit during the defrost cycle and the air flow through the secondary air band is reversed during the defrost cycle as compared to the refrigeration cycle.

It is a further object of the invention to maintain the air flow in the primary air band conduit in the same direction during both the refrigeration and defrost cycles.

It is a further object of the invention to provide means for drawing ambient air from the secondary air band conduit into the primary air band conduit during the defrost cycle while preventing such transfer during the refrigeration cycle.

SUMMARY OF THE INVENTION

The invention comprises an arrangement in which a baffle located in the plenum chamber of the secondary air band conduit is pivotable between two positions. The baffle is also connected to one or more doors located in the plenum chamber housing which, when open, communicate the plenum chamber with the ambient atmosphere. In the first baffle position, the doors are closed and fans mounted in the baffle circulate air through the secondary conduit in a first direction to create an air curtain across the open front of the display case. When the baffle is pivoted to its second position, the plenum doors open to the atmosphere. In this position, which occurs during the defrost cycle, the baffle directs air through the secondary air band conduit in a direction opposite to the air flow path during the refrigeration cycle.

Adjacent the air curtain inlet are a plurality of diverter ducts which permit air to flow from the secondary air band conduit into the primary air band conduit only during the defrost cycle. The ambient air flowing into the primary conduit from the secondary conduit mixes with the primary conduit air flow and follows the same path as the primary air flow which remains unchanged between the refrigeration and defrost cycles.

In a second embodiment, reversible fans are mounted in the secondary band plenum chamber. During a defrost cycle, these fans reverse direction to draw ambient air into the secondary band conduit outlet and propell the ambient air through this conduit in the opposite direction to its normal flow during a refrigeration cycle. In addition, movable baffle plates are provided in place of the diverter duct assembly. During a defrost cycle, these baffles shunt air flowing through the secondary band conduit directly into the primary refrigeration conduit adjacent the inlet thereof, which is closed off by the baffles.

Specific preferred embodiment of the invention will be described below with reference to the appended drawing figures.

BRIEF DESCRIPTION OF THE DRAWINGS

FIG. 5 is an enlarged side sectional view of the block V in FIG. 1, showing details of the diverter duct;

FIG. 6 is a front view of the sepaator panel and diverter duct assembly;

FIG. 7 shows a side section elevation of a second embodiment;

FIGS. 8 and 9 are enlarged side sectional views of block VIII in FIG. 7 showing details of the diverter assembly of the second embodiment for refrigeration and defrost cycles, respectively;

FIG. 10 is an enlarged side sectional view of block X of FIG. 7 showing details of the secondary air band plenum chamber of the second embodiment;

FIG. 11 is a partially exploded perspective view of the secondary air band plenum chamber of the first embodiment;

FIG. 12 is a perspective view of the diverter duct assembly of the first embodiment; and FIG. 13 is a perspective view of the diverter assembly of the second embodiment.

DESCRIPTION OF THE PREFERRED EMBODIMENTS

Figure 2:
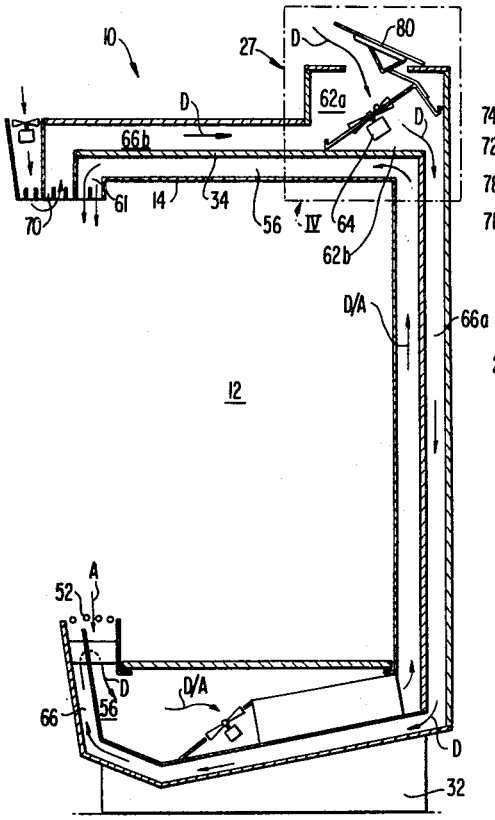
FIGS. 1 and 2 show a side section elevation of the refrigerated open front display case and air flow patterns for refrigeration and defrost cycles, respectively.

Referring first to FIGS. 1–6 an upright refrigerated display cabinet or case assembly, generally indicated at 10, comprises display space 12 defined by an upper panel 14, a bottom panel 16, and a rear panel 18 extending in a generally upright direction between the top and bottom panels. Extending upwardly a short distance from bottom panel 16 is a display section front panel 20. Display space 12 is bounded on the sides by a pair of end walls (not shown) and an open front 22. Shelves (not shown) may be mounted, preferably adjustably, on suitable uprights fixed to or made an integral part of rear wall 18, in a conventional manner.

Figure 1:
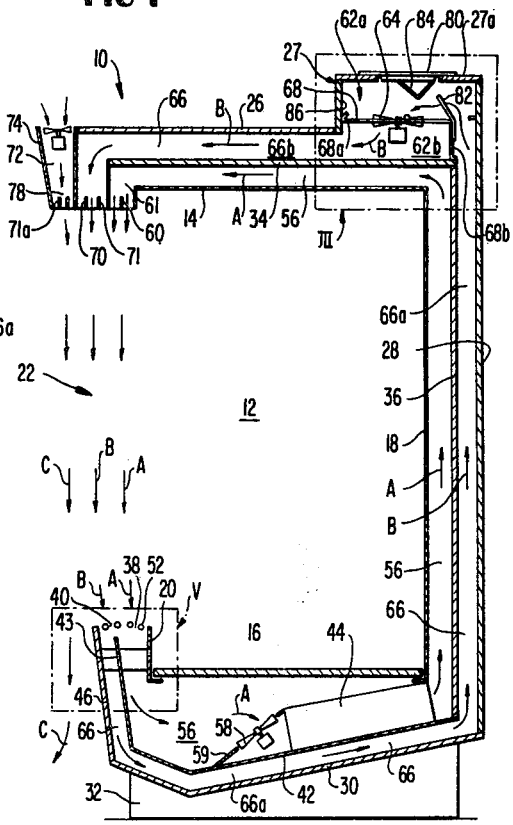
Figure 4:
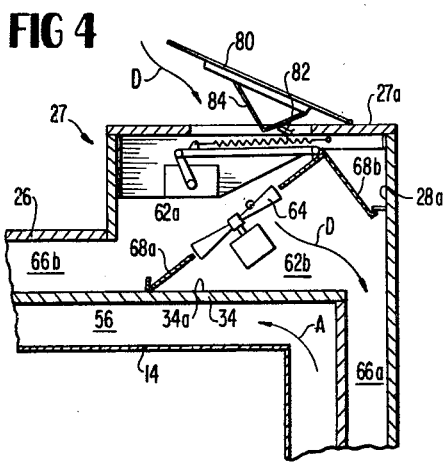
FIG. 4 is an enlarged side sectional view of block IV of FIG. 2, showing details of the secondary air band plenum chamber during the defrost cycle.

The exterior of the case is defined by an exterior top member 26, a vertical rear wall 28, and a bottom member 30, which may be flat, or if shaped as shown in FIG. 1, may rest on a support base 32 which sits level on the floor.

Intermediate cabinet top 26 and display area top 14 in the space therebetween is an upper divider panel 34. Located in the space between case back wall 28 and display area back wall 18 is a vertical panel 36 extending vertically from the rear of upper panel 34.

A bottom separator panel 42 is located in the space between case bottom 30 and display bottom 16, closer to case bottom 30. A set of conventional evaporation coils 44 is advantageously located in the space between display bottom 16 and bottom separator panel 42.

A front outer cabinet panel 46 extends from the front of case bottom 30 in a generally vertical direction. Front panel 46 extends up from the floor approximately 24–30 inches. By way of example, but not limitation, the overall height of the refrigerated cabinet (back) may be 81½ inches, overall height (front) 78 inches, overall depth, 45¼ inches, display front opening height 46 inches and overall length 8–12 feet.

Intermediate front cabinet panel 46 and the front display section panel 20 is an upwardly extending separator panel 43 which extends from and is a continuation of bottom separator panel 42. A grille 52 extends along the bottom edge of access opening 22 between panels 20 and 46, defining inlets 38 and 40 of primary and secondary air band conduits, respectively.

Display section panels 20, 16, 18 and 14, on the one hand, and separator panels 43, 42, 36 and 34, on the other hand, define between them an inner refrigerated air flow conduit 56 extending from inlet 38 substantially along the entire length of the case around and adjacent the bottom, back and top of display area 12 to an outlet 61 containing downwardly oriented directional louvers 60. A plurality of motor driven fans 58 (preferably two each for 8 foot cases, or three each for 12 foot cases) are spaced apart across the width of the case and are mounted in a baffle plate 59 preferably located upstream of evaporating coils 44 (as shown). Fans 58 act as air propulsion means to constantly circulate air drawn into conduit 56 through inlet 38, through conduit 56, including refrigeration coils 44, through outlet 61 and down across the open front of the display case, as indicated by arrows A, and back into conduit 56 through inlet 38 to be recirculated.

A housing 27 extending upwardly from the rear portion of cabinet top panel 26, as shown, defines a secondary air band plenum 62. An adjustable L-shaped baffle 68 divides plenum 62 into two subchambers **62*a* and 62*b* which alternately communicate with subconduit portions 66*a* and 66*b* of secondary air band conduit 66. A plurality of secondary band fans 64, preferably corresponding in number to primary air band fans 58, are mounted in L-shaped baffle 68. Secondary air band plenum 62 comprises a portion of a secondary air band conduit 66 generally defined between outer case panels 26, 28, 30 and 46, on the one hand, and separator panels 34, 36, 42 and 43** on the other hand.

It will be understood that the construction thus far described extends substantially across the entire width of the refrigerated cabinet.

Figure 3:
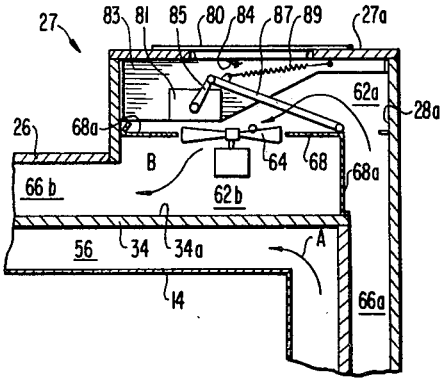
FIG. 3 is an enlarged side sectional view of block III of FIG. 1, showing details of the secondary air band plenum chamber during the refrigeration cycle.

In the normal refrigeration cycle, baffle 68 is disposed as shown in FIG. 3 such that subchamber **62*a* is in open communication with subconduit 66*a* and subchamber 62*b* is in open communication with subconduit 66*b*. Fans 64 act as air propulsion means to constantly circulate air drawn into conduit 66 through inlet 40, through subchambers 62*a* and 62*b*, subconduit 66*b* and out through an outlet 70 normally containing downwardly oriented directional louvers 71, to flow air downwardly across the front of display space 12 toward inlet 40. This creates a secondary air band, indicated by arrows B, outwardly of the primary refrigerated air band, designated by arrows A. The secondary air band forms a protective guard curtain of air continguous with the primary refrigerated inner air band across the open case front to prevent infiltration of ambient room air into the display area 12. During normal operation, the temperature of the recirculated secondary air band through conduit 66** is at a temperature somewhat higher than the temperature of the primary refrigerated air band but below ambient temperature.

In a preferred arrangement, a third air band, designated by arrows C, is maintained substantially across the open front of the display case. This third air band is composed of ambient air drawn, by means of a plurality of fans 76, preferably the same in number as fans 58 and 64, into a plenum chamber 72 defined by a housing 74 located on the exterior of the cabinet 10. Plenum chamber 72 opens into an outlet 78 which is covered by an extension **71*a* of outlet grille 70 to direct air through outlet 78 and downwardly across the open front of the display case, as indicated by arrows C. This third air band is not recirculated through the case, but exits outwardly of front panel 46** into the aisle area of the store, so that the ambient air can warm the aisle for customer comfort, as well as adding inertia to the total air curtain formed by the primary and secondary air bands.

In addition to the adjustable baffle 68 located in plenum chamber 62, there are a plurality of doors 80 pivotally mounted on an upper surface **27*a* of housing 27 (see FIG. 11). Fixed to the L-shaped baffle 68, preferably at or adjacent the corner of the "L", are levers 82 (corresponding in number to doors 80) which are slidably movable, upon pivotal movement of baffle 68, across the undersurface of door 80 to engage a cam member 84 fixed to the inside surface of door 80**.

The movement of baffle 68 may be controlled by one or more motors 81 mounted on support pieces 83. A rotatable arm 85 driven by motor 81 is connected to baffle plate 68 by connecting rod 87. When motor 81 is energized, either manually or by thermostatic control elements detecting defrost cycle initiation conditions, motor 81, acting through arm 85 and connecting rod 87, causes baffle 68 and fans 64 to rotate into the defrost position shown in FIG. 4. The rotation of baffle 68 causes doors 80 to pivot open, thereby opening plenum chamber 62 into communication with the ambient atmosphere. A spring 89, connected between the support piece 83 and connecting rod 87 exerts a biasing force such that when motor 81 is de-energized arm 85 rotates in the opposite direction, causing baffle 68 and thus doors 80, to return to their original positions, as shown in FIG. 3.

During the normal refrigeration cycle (FIGS. 1 and 3), baffle plate 68 is arranged such that one end **68*a* engages the interior of a side wall 86 of housing 27 and the second edge 68*b* of baffle 68 contacts the surface 34*a* of separator panel 34 facing duct 66. Fan 64, therefore, circulates air through conduit 66** in the direction indicated by arrows B.

During the air defrost cycle (FIGS. 2 and 4) it is desired to draw in ambient air to the secondary air band and to reverse the air flow through conduit 66. This is accomplished by rotating baffle plate 68 about its pivot axis, in the manner described above, so that end **68*a* engages surface 34*a* of separator panel 34 and end 68*b* engages the inside surface 28*a* (or a protrusion thereof, FIG. 4) of the upper extension of case back wall 28 forming part of the housing 27. The pivotal movement of baffle plate 68 causes lever 82 to contact cam surface 84 and pivot door 80 to its open position. This opens plenum chamber 62 to the atmosphere to allow fan 64 to draw ambient air in along the path indicated by arrows D. Ambient air thus drawn into plenum chamber 62 is circulated by the propulsive force of fans 64 through conduit 66 in the direction opposite to the air flow through conduit 66** during the refrigeration cycle.

Referring to FIGS. 5 and 6 separator panel 43 has a diverter assembly formed therein comprising openings 90 located below inlet grille 52 to permit communication between conduits 56 and 66. Cover plates 92, having an arcuate cross section and extending transversely on either side of panel 43 substantially across each of conduits 56 and 66, cover the upper part of openings 90. A plurality of such diverters are located across the entire width of panel 43 (see FIG. 12).

The purpose of the diverter assembly is to provide an open path for ambient air flowing through conduit 66 in the direction of arrows D to be drawn into and through conduit 56. Fans 58, located downstream of the diverter assembly create sufficient suction so that during the defrost cycle, with air flowing in the direction of arrows D, a substantial portion of the ambient air flowing through conduit 66 is drawn into and through conduit 56.

It will be noted that during the defrost cycle, air flowing through primary conduit 56 flows in the same direction as during the refrigeration cycle. This permits maintenance of the primary air band across the open front of display section 12, which, even though it is warmed by the incoming ambient air from conduit 66 through the diverter assembly, is still sufficiently cool to inhibit moisture-laden room air from entering display space 12 directly.

Maintenance of the primary air band during the defrost cycle also aids in directing the remainder of the ambient air flowing through conduit 66 to be drawn into conduit 56 adjacent grille 52, as indicated by arrows D' in FIG. 5. In this way, substantially all of the ambient air flowing through conduit 66 is diverted into and through conduit 56.

During the defrost cycle, the flow of refrigerant through the refrigerating coils is halted and the warmer ambient air drawn in through the open door 80 by fans 64 and through conduit 66 and into conduit 56, flows over and through the refrigeration coils 44 to melt any ice, snow or frost formed thereon.

Also during the defrost cycle, a portion of the ambient air flowing out of conduit 78 is diverted into conduit 66 through outlet 70 by the suction created by fans 64. This increases the total amount of ambient air flowing through conduit 66 and conduit 56 for defrosting coils 44.

It will be seen that the transition from the refrigeration cycle to the defrost cycle requires only that the supply of refrigerant to coils 44 be halted during the defrost cycle and that a baffle plate be pivoted which causes a door to open the conduits to the ambient air. The controls do not require that any fans be turned on or off during the defrost cycle and/or refrigeration cycle; in fact, the three sets of fans 58, 64 and 76 run continuously during both the refrigeration and defrost cycles. This has the advantage of increasing fan motor life by avoiding starting and stopping the fans. One cause of fan motor burn-out is the current surge generated in the motor windings during start-up.

Another advantage of this embodiment is that the air curtain formed by the primary air band across the open front of the display section 12 is maintained at all times to inhibit infiltration of moisture-laden ambient room air into the display section, thereby cutting down on the amount of frost which would otherwise accumulate during a refrigeration cycle due to the presence of ambient air in the display space 12.

FIGS. 7–10 and 13 show a second embodiment of this invention in which like reference numerals denote similar elements as in the first embodiment. The movable baffle 68 and fans 64 of the first embodiment are replaced, in this second embodiment, by a stationary baffle 102 and reversible fans 104. Additionally, the diverter duct assemblies of the first embodiment are replaced, in this second embodiment, by a movable baffle plate 106 having a similar function to the diverter duct assembly, i.e. diverting air flowing in a reverse direction in the secondary air band conduit 66 into the primary air band conduit 56 upstream of fans 58 and coils 44.

During a refrigeration cycle, fans 104 rotate in the direction of the solid line arrow F (FIG. 10) to draw air through secondary air band conduit 66 in the direction of solid line arrows B'. Also during the refrigeration cycle, baffle plate 106 is positioned as shown in FIGS. 7 and 8. In this configuration, the air flow is the same as that described above with respect to the refrigeration cycle of the first embodiment.

In the defrost cycle, fans 104 are switched, either manually or by conventional thermostatic control means, to rotate in the opposite direction, as indicated by the dotted line arrow R. This change in fan rotational direction reverses the secondary band air flow in conduit 66, as shown by dotted line arrows E in FIG. 10. At the same time, baffle plate 106 is pivoted about pivot pins 108, by a motor and articulated arm mechanism 110, into the position shown in FIG. 9.

In this arrangement, a negative pressure head is maintained in conduit section **66*b* to draw ambient air into secondary air band outlet 70 to flow through conduit 66 in the reverse direction E. In the defrost condition, baffle plates 106 maintain conduits 66 and 56 in direct and open communication; primary air fans 58 help draw the reverse flowing ambient air into conduit 56 to propel it through coils 44 to exit from primary conduit outlet 61**.

It is apparent that the movable baffle 106 of the second embodiment could be used in place of the diverter duct assembly of the first embodiment in combination with pivotable baffle 68 and fans 64 of the first embodiment; similarly, the reversible fan arrangement of the second embodiment could be used in place of the pivotable baffle 68 and fans 64 of the first embodiment in combination with the diverter duct assembly of the first embodiment.

A primary purpose of the air defrost system of the invention is that the middle or second band should have its air reversed so that warm air is taken from a high position above the refrigerator case 10 and is directed into the refrigerator so that it may be drawn into the primary refrigeration band 56 for the purpose of providing the heat necessary to accomplish defrosting of the coils 44.

The invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. In a refrigerated display cabinet having an access opening for communicating a storage and display space within the cabinet with the ambient air, means for providing at least a primary refrigerated air band and a secondary guard air band across the access opening in substantially the same air flow direction during a normal refrigeration cycle;

an improved method of defrosting an air cooling mechanism located in the flow path of the primary band, comprising the steps of:

reversing the flow of air in said secondary band from the flow thereof during said normal refrigeration cycle, whereby ambient air is drawn into said secondary band flow path;

maintaining the air flow of said primary band in the same direction as in said normal refrigeration cycle to maintain a substantially continuous primary band air curtain across the access opening during both the refrigeration and defrost cycles; and diverting at least a significant portion of the reverse flow of air from the secondary band into the primary band between the downstream or return end of the access opening and the air cooling mechanism during the defrost cycle to thereby cause relatively warm air to flow through said air cooling mechanism and defrost same.

2. In the refrigerated display cabinet according to claim 1, wherein said means for providing said primary and secondary bands comprise first and second air circulating fan means, respectively;

said improved defrost method further comprising the step of:

reversing the air circulating direction of said second fan means during a defrost cycle from the air circulation direction thereof during a refrigeration cycle.

3. In the refrigerated display cabinet according to claim 2, the improved defrosting method further comprising the step of:

reversing the rotating direction of said second fan means during the defrost cycle to thereby reverse the air circulating direction thereof.

4. In the refrigerated display cabinet according to claim 1, wherein said second fan means are mounted to a movable baffle, said improved defrosting method comprising the step of:

pivoting said baffle to thereby reverse the airflow direction of said secondary band without reversing the direction of rotation of the second fan means.

* * * * *

Disclaimer 4,207,747.—*Elmer J. Subera,* Cassopolis, and *Melvin W. Steelman,* Niles, Mich. AIR DEFROST SYSTEM USING SECONDARY AIR BAND COMPONENTS. Patent dated June 17, 1980. Disclaimer filed July 2, 1984, by the assignee, *Tyler Refrigeration Corp.*

The term of this patent subsequent to Mar. 20, 1996, has been disclaimed.

[*Official Gazette October 9, 1984.*]